US005878307A

United States Patent [19]

Greenlaw et al.

[11] Patent Number: 5,878,307

[45] Date of Patent: Mar. 2, 1999

[54] TONER CONTAINER HAVING ROTARY SEAL

[75] Inventors: David Greenlaw, Milford; Arthur Kroll, Nashua; Daniel Lyman, Manchester; Antonio Russo, Nashua, all of N.H.

[73] Assignee: Nashua Corporation, Nashua, N.H.

[21] Appl. No.: 22,989

[22] Filed: Feb. 12, 1998

[51] Int. Cl.[6] ..... G03G 15/08

[52] U.S. Cl. ..... 399/106; 399/262

[58] Field of Search ..... 399/102, 103, 399/106, 119, 352, 358, 362; 222/167

[56] References Cited

U.S. PATENT DOCUMENTS

| | | | |
|---|---|---|---|
| 4,611,730 | 9/1986 | Ikesue et al. | 222/167 |
| 4,744,493 | 5/1988 | Ikesue et al. | 222/167 |
| 4,878,603 | 11/1989 | Ikesue et al. | 222/167 |
| 4,963,940 | 10/1990 | Nemoto et al. . | |
| 5,084,734 | 1/1992 | Yoshino et al. . | |
| 5,294,963 | 3/1994 | Nakano et al. | 399/106 |
| 5,461,466 | 10/1995 | Girard et al. . | |
| 5,576,816 | 11/1996 | Staudt et al. | 399/262 |
| 5,722,019 | 2/1998 | Nakajima | 399/262 |
| 5,812,915 | 9/1998 | Farkash | 399/262 |

*Primary Examiner*—Sandra L Brase

[57] ABSTRACT

A toner cartridge for supplying toner to a replenishment apparatus of an electrophotographic imaging device has an elongated cylindrical container filled with toner. The container has a longitudinal axis, an open end and a closed end. An end cap is adapted and arranged to close the open end and to accommodate relative rotational motion between the container and the end cap. The end cap has a flange portion defining an open end terminating in an end portion having an edge. An elastomeric seal is provided to effect a positive, relatively low-friction toner seal between a relatively rotating container and the end cap. The seal in an exemplary embodiment comprises an elastomeric band, which is sized properly to affix onto the outside diameter of the cap end portion, with a portion of the seal extending beyond the cap end portion. This extending part of the seal conforms around the inside of the cap end portion such that when the cap is slid over the container during assembly, the seal rides over, and conforms to, the outside diameter of the container. Accordingly, as the bottle and cap are rotated relative to one another, the seal conforms and seals. The toner is discharged through an opening in the end cap.

12 Claims, 2 Drawing Sheets

TONER CONTAINER HAVING ROTARY SEAL

BACKGROUND OF THE INVENTION

1. Field of the Invention

The present invention relates to electrostatic imaging devices in general, particularly to toner cartridges for supplying toner to a replenishment mechanism for an electrostatic imaging device and, more particularly, to a replacement toner cartridge having a rotary seal.

2. Background

Devices for replenishing the toner in an electrophotographic or dry-toner type imaging device are known in the art. Generally, in such imaging devices, dry toner is supplied from a storage region to an imaging drum or film, where it is subsequently transferred to the image carrier and fused thereto to form a permanent image. As the supply of toner becomes depleted after repeated images are formed, it becomes necessary to replenish the supply.

The prior art contains many examples of the types of arrangements that are presently used for replenishing dry toner in imaging devices. For example, the replenishing supply of toner can be in the form of a relatively simple container 12 having a spout which mates to a storage region of the imaging device, and the toner might be dumped by gravity into the storage region.

U.S. Pat. No. 4,878,603 to Ikesue et al. describes an arrangement wherein replenishing toner is supplied in a cylindrical cartridge, one end of which contained a discharge opening. A removable gear was attached to the discharge end of the cylinder, the gear having teeth about its periphery. By attaching the gear and cartridge combination to a replenishment mechanism of the imaging device, the gear teeth of the cartridge was matable with a drive sprocket, which when activated rotated the toner replenishment cartridge about its longitudinal axis. A spiral guide rib raised on the inside surface of the cylindrical cartridge aided to feed the powder toward the discharge end of the cartridge and into the replenishment mechanism of the imaging device. This replenishment system requires the user to remove an end cap or a cover from the toner cartridge and also a sealing mechanism between the toner container and the imaging device replenishment mechanism.

New and better methods for supplying replenishment toner are still being sought.

SUMMARY OF THE INVENTION

The present invention provides a toner cartridge comprising an elongated container having a longitudinal axis, an open end and a closed end. An end cap is adapted and arranged to close the open end of the container and to accommodate relative rotational motion between the elongated container and the end cap. Upon the relative rotation of the end cap and the elongated container, displacement of replenishing toner from a cartridge to an image forming device is effected without removing the end cap. A rotary seal is provided between the container and the cap, which prevents the undesirable extraneous leakage of toner at the junction between the container and the end cap.

In accord with the present invention, a toner cartridge is provided for supplying toner to a replenishing apparatus for an image forming apparatus, said toner cartridge comprising:

a container accommodating a quantity of toner, the container having an exterior surface, a closed end and an open end;

an end cap engaging the open end of the container and being relatively rotatable with respect thereto, the end cap having a flange portion defining an open end of the end cap and having an internal surface and an external surface, the flange portion terminating at an end portion having an edge; and a flexible seal circumscribing and attached to the end portion of the end cap, the seal further having:

a first portion adjacent to the external surface thereof of the end cap;

a second portion substantially conforming to the edge of the end portion; and a third portion extending beyond the edge of the end portion and having a terminus;

wherein the third portion of the seal, which extends beyond the edge of the end portion of the end cap, engages the exterior surface of the container to provide a rotatably sealing engagement between the seal and the exterior surface of the container.

In an exemplary embodiment, the cartridge comprises an elongated cylindrical container filled with toner. The container has a longitudinal axis, an open end and a closed end. An end cap is adapted and arranged to close the open end and to accommodate relative rotational motion between the container and the end cap. The end cap has an annular flange portion (1) defining an end cap open end for receiving the open end of the container, and (2) terminating in an end portion having an edge. An elastomeric seal is provided circumscribing the container to effect a positive, low-friction toner seal between a relatively rotating container and end cap. The seal in an exemplary embodiment comprises an elastomeric band, which is sized properly to affix onto the outside diameter of the cap end portion, with a portion of the seal extending beyond the cap end portion. This extending part of the seal conforms around the inside of the cap end portion such that when the cap is slid over the container during assembly, the seal rides over and seals against the outside diameter of the container. Accordingly, as the container and cap are rotated relative to one another, the seal conforms to the exterior surface of the container and seals the space between the end cap and the container, as will be more fully described herein.

The invention further provides a toner cartridge that is easily mounted to and detached from a toner replenishment mechanism of an image forming machine without the necessity for removing the container end cap.

BRIEF DESCRIPTION OF THE DRAWINGS

Other objects, advantages and features of the invention will become apparent in view of the following detailed description and in conjunction with the following drawings.

DETAILED DESCRIPTION OF AN ILLUSTRATIVE EMBODIMENT

The present invention will be described herein with reference to the drawings and an illustrative embodiment of a toner cartridge.

Figure 1:
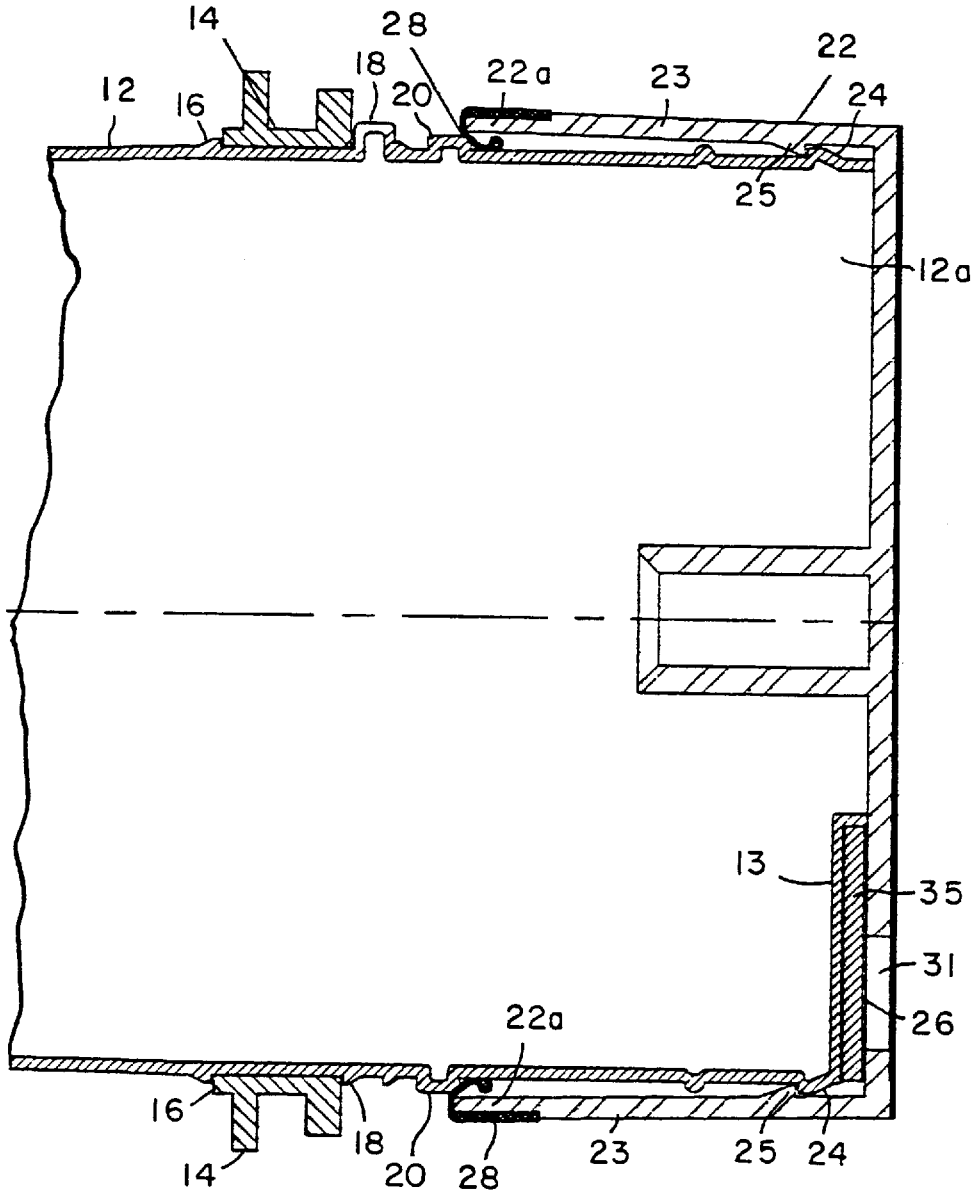
FIG. 1 is a partial cross sectional view of a toner container and end cap arrangement employing a rotary seal according to the instant invention.

Referring to FIG. 1, the toner cartridge according to one embodiment of the instant invention comprises a container 12, which in a preferred embodiment is in the form of a molded cylinder, having a closed end (not shown) and an open end 12*a*. The container 12 can be of substantially constant cross sectional area, or can be tapered, for example to have a smaller diameter at the closed end than at the open end 12*a*. Near the open end 12*a*, a driving gear 14 can be provided around the circumference of the container 12. The gear 14 is positioned between two detent ridges 16, 18 that are integrally molded in, or otherwise attached to, the container wall, such that the gear 14 cannot be readily removed. The gear 14 can be constructed and arranged to rotate around the container 12 about one rotation, but is prevented from further rotation in the same direction by a stop or other detent or mechanism, such as a ratcheting pawl, that is integrally molded in the container wall or otherwise attached thereto. A seal ridge 20 is integrally formed or fixedly placed on the container wall.

An end cap 22, which in a preferred embodiment is designed to be non-removable once attached, is provided for the container 12. The cap has a flange portion 23 defining an open end portion 22*a* of the cap 22. The cap 22 is designed to be relatively rotatable with respect to the container 12. The cap 22 has an opening 31 through which toner can exit from the container 12 as the container is rotated.

In the illustrative embodiment, a bearing ridge or shoulder 24 is formed on the outer wall of the container 12, and a mating pawl 25 is formed on the inner wall of the cap flange portion 23, such that the cap is prevented from being removed from the open end 12*a* of the container, but is permitted to accommodate relative rotation with respect to the container. According to the illustrative embodiment, the container 12 and the cap 22 can also have one or more seals 26 at the open end 12*a* to prevent spillage of toner through opening 31 in the end cap during storage and handling and to facilitate clean delivery of toner to the image-forming apparatus.

A rotary seal 28 according to the instant invention is provided between the cap 22 at an end portion 22*a* thereof, and the container 12, as will be more fully described with reference to FIG. 2 hereinbelow.

In use, the cap 22 is attached to a toner container 12 that is rotatable relative to the cap 22. The flange portion 23 of the cap is dimensioned so as to provide a clearance fit between the inside surface of the flange portion 23 and the outside surface of the container 12. In a preferred embodiment, the cap 22 is substantially cylindrical, but can have a non-cylindrical exterior portion (not shown) which can engage with portions of the replenishment mechanism of an image forming machine, such as the toner replenishing device, to prevent rotation of the cap 22 relative to the toner replenishing device when the toner container 12 is rotated via mechanical input to gear 14.

Preferably, the open end 12*a* of the container is formed with a radially extending shelf portion 13, which accommodates a sealing material 35. The sealing material 35 seals against the end cap 22 during storage and handling and prevents leakage of toner through opening 31 in the end cap. Preferably the sealing material 35 is a foam material, for example Tyvac®, having a polytetrafluoroethylene (or other low friction material) coating for rotation against the inner surface of the end cap 22. The foam material is preferably held in place with an adhesive.

The cap 22 is snugly held to the container 12, for example as described above by the interlocking of (1) an external bearing surface or shoulder 25 on the container 12 wall near the open end 12*a* of the container and (2) an internal ridge or pawl 25 on the internal cylindrical wall of the cap 22, preferably at its closed end, or other equivalent structures. A rotary elastomeric seal 28 is disposed around the circumference of the cylinder between the edge of the open end of the cap 22 and the cylinder wall.

Figure 2:
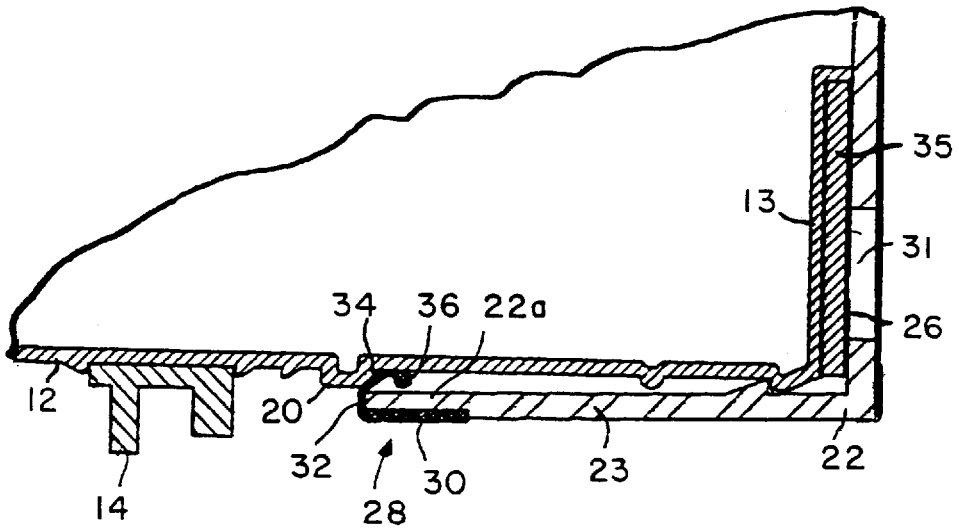
FIG. 2 is an enlarged partial cross sectional view of a toner container arrangement as illustrated in FIG. 1 depicting the seal according to the instant invention.

Referring to FIG. 2, the structure of the seal according to a preferred embodiment of the present invention will be described. The rotary seal 28 is preferably formed from an elastomeric material to effect a positive, relatively low-friction toner seal between a relatively rotating container 12 and the end cap 22, preferably at an end portion 22*a* of the end cap. Preferably, the seal is comprised of a material selected to exhibit such lubricity so as to form a low-friction seal. The seal 28 can be formed of any number of natural or synthetic rubbers or elastomers exhibiting deformation and elastic recovery, which can include, while not limited to, natural or synthetic rubber, cis-1,4-polyisoprene, ethylene-propylene-diene terpolymers (EPDM rubber), styrene-butadiene copolymer, polychloroprene (neoprene), nitrile, butyl, sulfide, polyurethane or polysulfide rubbers, either cross-linked or otherwise, or other such elastomeric materials including foams. Non-cross-linked elastomers such as polyolefins, such as TPO rubbers, can also be used. Typically, the seal is made of a material having a durometer of between 20 and 80 on the Shore A scale, preferably between 40 and 60, and more preferably between 45 and 55. The material can also contain additives to increase lubricity and flexibility.

Figure 3:
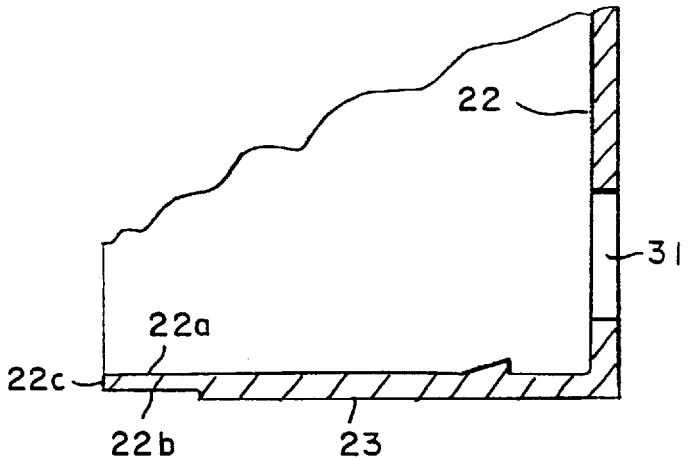
FIG. 3 is an enlarged partial cross sectional view of an end cap arrangement.

The seal in an exemplary embodiment comprises an elastomeric band which is sized properly to have a first portion 30 to affix onto the outside diameter of the cap end portion 22*a* in an annular channel 22*b* formed therein, as shown in FIG. 3. As seen further in FIG. 3, the cap end portion 22*b* terminates in an edge 22*c* in the axial direction. A second portion 32 of the seal preferably extends beyond the cap edge 22*c* in a substantially conforming manner. The seal also preferably comprises a third portion comprising an extending part 34 which conforms around the inside of the cap end portion 22*a* such that when the cap 22 is slid over the container 12 during assembly, the seal rides over and conforms to the outside diameter of the container 12, eventually contacting the seal ridge 20 on the container. Accordingly, as the bottle and cap 22 are rotated relative to one another, the seal conforms to the exterior surface of the container and seals, preventing the passage of toner. Optionally, the seal 28 also can comprise a fourth portion, which has a flexible annular ridge 36 or bead with a larger cross section than the extending part 34 for increased engagement with the exterior surface of the container 12.

The container, gear and end cap typically are made of conventional materials used for these parts such as, for example, high density polyethylene, polypropylene, polystyrene, polystyrene/butadiene copolymer, ABS, or the like.

Although the invention has been shown and described with respect to exemplary embodiments thereof, various other changes, additions and omissions in the form and detail thereof can be made therein without departing from the spirit and scope of the invention. For example, in place of affixing the seal to the outside edge of the end cap. the seal material can be affixed to an annular band that is positioned within the end cap so that the second portion of the seal extends beyond an edge of the annular band and forms the seal with the exterior surface of the container.

What is claimed is:

1. A toner cartridge for supplying toner to a replenishing apparatus for an image forming apparatus, said toner cartridge comprising:

a container accommodating a quantity of toner, the container having an exterior surface, a closed end and an open end;

an end cap engaging the open end of the container and being relatively rotatable with respect thereto, the end cap having a flange portion defining an open end of the end cap and having an internal surface and an external surface, the flange portion terminating at an end portion having an edge; and a flexible seal circumscribing and attached to the end portion of the end cap, the seal further having:

a first portion adjacent to the external surface thereof of the end cap;

a second portion substantially conforming to the edge of the end portion; and a third portion extending beyond the edge of the end portion and having a terminus;

wherein the third portion of the seal, which extends beyond the edge of the end cap, conforms to the exterior surface of the container to provide a rotatably sealing engagement between the seal and the exterior surface of the container.

2. The toner cartridge of claim 1, wherein the end portion of the end cap further comprises an annular channel, wherein the first portion of the seal is at least partially within the annular channel.

3. The toner cartridge of claim 1, wherein the seal further comprises a fourth portion at the terminus of the third portion, the fourth portion comprising a flexible annular ridge.

4. The toner cartridge of claim 1, wherein the seal is made of a natural or synthetic elastomer.

5. The toner cartridge of claim 4, wherein the seal is made of EPDM rubber.

6. The toner cartridge of claim 1, wherein the container comprises a circumferential ridge extending from the external surface thereof, located proximate to the edge of the end portion of the end cap flange, such that the third portion of the flexible seal contacts the said circumferential ridge.

7. The toner cartridge of claim 1, further comprising engagement means for preventing the removal of the end cap from the container.

8. A cap and seal arrangement for a container that is relatively rotatable with the cap, said arrangement comprising:

a cap body having a flange portion defining an open end of the cap and having an internal and an external surface, the flange portion terminating at an end portion having an edge;

a flexible seal attached to the end portion of the end cap on the external surface thereof, the seal configured to substantially conform to the edge of the end portion, the seal having a portion extending beyond the edge of the end portion to sealingly engage said container.

9. The end cap of claim 8, wherein the end portion further comprises an annular channel, wherein a first portion of the seal is at least partially within the annular channel.

10. The end cap of claim 8, wherein the seal further comprises a flexible annular ridge.

11. The apparatus of claim 8, wherein the seal is made of a natural or synthetic elastomer.

12. The apparatus of claim 8, wherein the seal is made of EPDM rubber.

* * * * *